United States Patent [19]

Kleinschmidt

[11] 4,243,979

[45] Jan. 6, 1981

[54] BURGLAR ALARM SECURITY CIRCUIT ARRANGEMENT

[75] Inventor: Peter Kleinschmidt, Munich, Fed. Rep. of Germany

[73] Assignee: Siemens Aktiengesellschaft, Berlin & Munich, Fed. Rep. of Germany

[21] Appl. No.: 858,156

[22] Filed: Dec. 7, 1977

[30] Foreign Application Priority Data

Dec. 13, 1976 [DE] Fed. Rep. of Germany ..... 2656399

[51] Int. Cl.[2] ..... G08B 13/16; G08B 13/18

[52] U.S. Cl. ..... 340/554; 343/5 PD; 367/94

[58] Field of Search ..... 340/16 R, 552, 554, 340/558, 560; 343/5 PD, 6 R

[56] References Cited

U.S. PATENT DOCUMENTS

| | | | |
|---|---|---|---|
| 3,074,054 | 1/1963 | Pearson | 345/5 PD X |
| 3,727,216 | 4/1973 | Antonio | 340/560 X |
| 3,801,978 | 4/1974 | Gershberg et al. | 340/554 X |
| 3,846,778 | 11/1974 | Galvin et al. | 340/560 X |

*Primary Examiner*—John W. Caldwell, Sr.

*Assistant Examiner*—Joseph E. Nowicki

*Attorney, Agent, or Firm*—Hill, Van Santen, Steadman, Chiara & Simpson

[57] ABSTRACT

A circuit arrangement, suitable for a burglar security device, has coincidence operation of two Doppler alarm devices. The difference frequency signal of the two Doppler frequency signals which are produced by the movement of an object within a protected area is employed as an alarm-triggering signal. The circuit arrangement has a product detector for the formation of the difference frequency signals, a subsequently connected low pass filter and a threshold value detector. The threshold value detector is designed such that the amplitude value of its detection threshold can be changed in dependence upon the frequency of a control signal supplied thereto, the frequency of the control signal being derived from one of the Doppler frequency signals, the dependence being designed such that the frequency dependence of the amplitude value of the detection threshold is fundamentally equal to the frequency-dependent attenuation characteristics of the low pass filter.

5 Claims, 2 Drawing Figures

BURGLAR ALARM SECURITY CIRCUIT ARRANGEMENT

CROSS REFERENCE TO RELATED APPLICATION

This application is related to an application of Walter Heywang, Max Guntersdorfer and Peter Kleinschmidt, Ser. No. 780,806, filed Mar. 24, 1977.

BACKGROUND OF THE INVENTION

1. Field of the Invention

This invention relates to a circuit arrangement which is particularly suitable for use in a burglar security device of the type which operates with two Doppler alarm devices, wherein the difference frequency signal of the two Doppler frequency signals produced by the movement of an object is employed as an alarm-triggering signal, and more particularly to such a circuit arrangement in which a produce detector is employed for forming the difference frequency signals, followed by a low pass filter and a threshold value detector.

2. Description of the Prior Art

It is known in the art to employ the Doppler principle to construct burglar security devices. In such devices, a transmitter emits radiation which is reflected by objects which must be considered, in particular, to consist of human beings. The reflected radiation is received and analyzed by a receiver. If the reflection takes place on a stationary object, the frequency of the received radiation generally agrees with the frequency of the transmitted radiation. If, however, the reflection occurs from an object which is moving at least with a speed component in the direction of the transmitter and/or the receiver, that is towards or away from the receiver, a Doppler frequency shift occurs in the received radiation in comparison to the frequency of the transmitted radiation.

Known burglar security devices which, for example, are commercially available employ electromagnetic radiation in the X-band (radio waves). The frequency range of these radiations lies, for example, at 9.5 GHz. Electromagnetic radiation of this kind can be handled relatively easily. It can be produced, for example, with a semiconductor Gunn diode, and the receiver is equipped, for example, with a Schottky diode. However, a device operating in the X-band has a disadvantage which is extremely serious, at least in individual situations, and which is based on the properties of the electromagnetic radiation. Electromagnetic radiation easily passes through walls, and in particular through windows, and will be reflected from a moving object, e.g. a human being, regardless of whether the person is moving in the area protected and monitored by the burglar device; the person may be in an adjoining passageway or outside of the building in the street. This disadvantage has been eliminated, through one technique, by rendering the device in question insensitive to such an extent that unfortunately it is entirely unreliable in monitoring the relevant area.

Burglar security devices which operate, not with radio waves, but with ultrasonic radiation, e.g. in a frequency range of about 40 KHz, are also already commercially available. An advantage of such devices is that, in comparison to devices operating with radio waves, they require a lower technical outlay and are correspondingly less expensive. However, the ultrasonic devices likewise have serious disadvantages. A fundamental disadvantage is that the emitted ultrasonic radiation may be influenced by air currents and suffer attenuation fluctuations. However, it is not possible to exclude turbulent air, in particular in heated rooms. In order to avoid a false alarm, the aforementioned technique was adopted by rendering the device extremely insensitive. For this reason, and for other reasons, ultrasonic devices have been used virtually only for monitoring small areas, such as motor vehicles and mobile homes.

In an earlier application of Walter Heywang, Max Guntersdorfer and Peter Kleinschmidt, Ser. No. 780,806, filed Mar. 24, 1977, a burglar security device was proposed which, in comparison to the prior art, has a high response sensitivity, on the one hand, and, on the other hand, has a high safeguard against false alarms.

The device proposed by Heywang et al, which operates with a transmitter for radiation to be transmitted, with the receiver for receiving the emitted Doppler frequency shifted radiation which has been reflected by a moving object, and with a device which serves to establish and analyze the reception of Doppler frequency shifted radiation, is characterized in that in the device there are provided two transmitting and receiving arms, of which one arm operates with radio waves and the other with ultrasonic waves. The device applies an analysis signal intended to trigger the alarm only when the Doppler frequency shifted radiation is received simultaneously in both arms, and an analysis signal is detected when the Doppler frequency of the two Doppler frequency shifted radiations differ from one another by no more than a frequency degree emitted in accordance with a tolerance width. In this previous proposal, the tolerance width is determined by the selection of the upper cut-off frequency of an output-end low pass filter.

In the Heywang et al application, an ultrasonic transmitter and a radio transmitter emit their respective radiations in an area to be protected. Reflected radiations are received by respective ultrasonic and radio wave receivers which contain demodulators which cause signals to occur at the respective outputs of the receivers which correspond to the Doppler frequency, assuming a Doppler shift has occurred due to a moving object in the protected area. In the example given, the Doppler frequency of the ultrasonic wave is four times the Doppler frequency of the radio wave. In order to normalize this difference, a divider is connected to the output of the ultrasonic receiver and has a division ratio of 4:1. The outputs of the ultrasonic receiving arm and the radio receiving arm are then fed to a product detector which feeds a low pass filter. The upper cut-off frequency of the low pass filter is dimensioned to provide the prescribed tolerance width for frequency comparison of the two Doppler signals and, upon an ideal frequency match, a direct current signal is provided for triggering an alarm. Each of the receivers may have a band pass filter connected to the output thereof for eliminating a response to Doppler velocities which are not of interest.

In another embodiment the two receivers and their band pass filters are provided to feed the relevant Doppler signals to other evaluation apparatus. The band pass filter of the ultrasonic arm is connected, for example, to a phase locked loop (PLL) circuit which has an oscillator feeding a mixer which receives the ultrasonic signal and which is phase locked thereto by way of a loop which includes an amplifier fed by the mixer and connected to control the frequency of the oscillator. The amplifier is also connected to control the frequency of a second oscillator in the radial wave branch, the natural frequencies of the two oscillators differing by a factor n of the predetermined ratio of the Doppler frequencies. The oscillator in the radio wave arm also feeds a mixer which receives the radio Doppler signal, this latter mixer supplying the mixing product of the two frequencies, the normalized ultrasonic frequency and the radio frequency, through a low pass output filter as in the previously discussed embodiment.

In another embodiment disclosed by Heywang et al, a pair of threshold value detectors are connected to the outputs of the respective receivers at the point where the receivers feed the respective band pass filters in order to detect reflections of excessive intensity which could be provided by high intensity radiation, as may be used for the purpose of jamming.

As is apparent from the foregoing, Heywang et al is concerned with the situation in which analysis signals based on extremely rapidly moving objects are increasingly smaller, the greater the speed of the relevant object.

SUMMARY OF THE INVENTION

An object of the invention is, for special applications, to provide a circuit arrangement for a further improved burglar security device which ensures that even extremely rapidly moving objects are detected with the same degree of detection sensitivity with which objects moving at a normally rapid speed and objects moving decidedly slowly are reliably detected, without the need to accept lesser reliability with respect to a false alarm.

The above object is attained, according to the invention, with a circuit arrangement which operates with coincidence of two Doppler alarm devices, in which the difference frequency signal of the two Doppler frequency signals which are produced by the movement of an object to be detected is employed as an alarm-triggering signal, in which the circuit arrangement possesses a product detector for the formation of the difference frequency signals, a subsequently connected low pass filter, and a threshold detector, and characterized in that the threshold value detector is designed in such a manner that the amplitude value of its detection threshold can be changed in dependence upon the frequency of a control signal supplied thereto, where the frequency of the control signal is derived from one of the Doppler frequency signals, and the dependency is designed such that the frequency dependence of the amplitude value of the detection threshold is fundamentally equal to the frequency-dependent attenuation characteristics of the low pass filter.

Advantageously, the frequency of the control signal can be derived from the Doppler frequency signal which has the higher frequency value.

According to another feature of the invention, the low pass filter has a frequency characteristic of a RC low pass element.

According to another particular feature of the invention, the detection threshold is controlled by employing a converter whose output voltage is dependent upon the frequency of the input signal of the converter. An attendant feature is the provision of a storage capacitor, and a time-controlled charging and discharging circuit which begins to charge the charge capacitor at the beginning of a period duration for the control of the Doppler frequency signal, and transmits the voltage value which is carried by the charging capacitor following relevant multiples of a half period duration of this Doppler frequency signal to the storage capacitor whose voltage value supplies the control signal. Advantageously, a double-symmetrical mixer may be provided as the product mixer.

The invention is based upon the newly recognized problem that in case of objects to be detected which move at different speeds, Doppler signals occur, the high frequency of which differs correspondingly and which may be related to one another in accordance with the concept of the aforementioned earlier proposal, and that the absolute frequency differences in the two Doppler frequency signals which are to be compared with one another in respect of coincidence increase in accordance with an increasing frequency of the Doppler frequency signals, i.e. with a higher speed of the object, which is significant in respect of a speed-independent tolerance of the frequency deviation occurring between the doppler frequency signals of one and the same object for the burglar security device. Such frequency deviations, i.e. different frequency values of the two Doppler frequency signals which are to be compared with one another and which originate from one and the same moving object which is to be detected normally occur for many different reasons, including, in particular, unavoidable multiple reflections. A tolerance width as provided in the earlier proposal is achieved by employing a low pass filter which is connected following the product detector and which only permits passage at different frequency signals of the two Doppler frequency signals which lie below a limit determined by the frequency-dependent attenuation characteristics of this filter. Generally, in particular in the case of a simple RC low pass element, the degree of attenuation will be one with which one skilled in the art is fully familiar and which is proportional to the frequency. The use, in itself extremely advantageous, of a simple RC low pass filter of this type, in combination with a threshold value detector having a constant amplitude value of its detection threshold, inevitably leads to the fact that in the case of rapidly moving objects having a correspondingly higher frequency of the Doppler frequency signal, the tolerance width, and thus the sensitivity, for a relatively great frequency deviation, relatively reduces.

The present invention now ensures that even in special situations of this kind, the speed-independent tolerance width set forth in the primary object is ensured. It is not necessary to accept a decrease in safeguard against a false alarm, this safeguard being ensured by the limited tolerance. In fact, a fundamental recognition of the invention is that the relevant safeguard against a false alarm in the case of speed-independent sensitivity is based upon the degree of the permitted, relative frequency deviation and the relative tolerance width.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
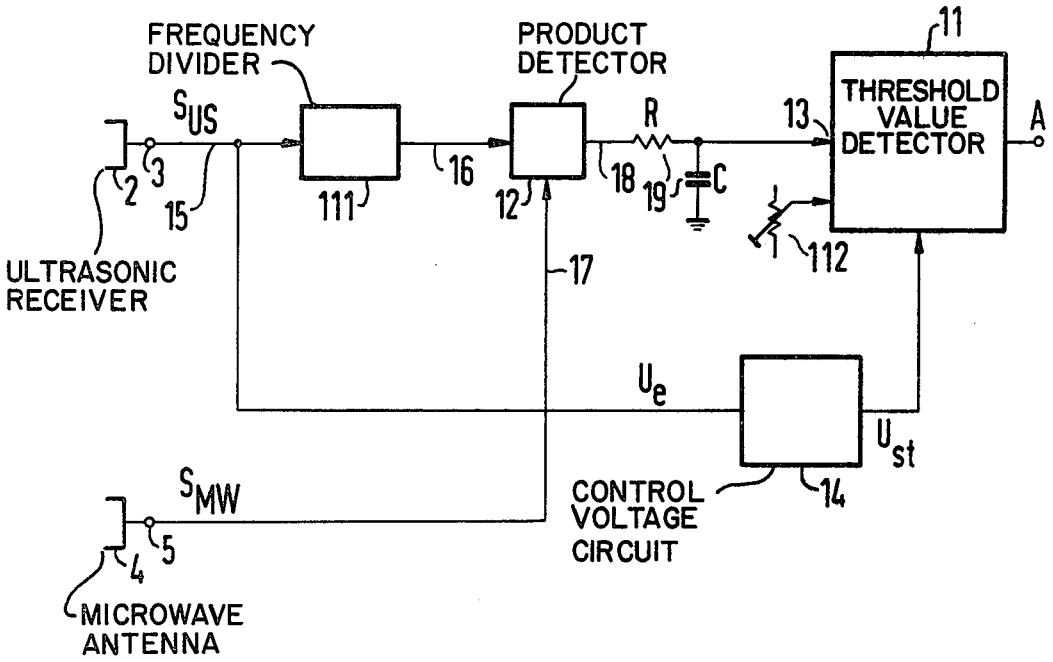
FIG. 1 is a block diagram illustration of a circuit arrangement constructed in accordance with the invention.

Referring to FIG. 1, the partially drawn boxes 2 and 4 designate receivers for reflected, Doppler frequency shifted radiation, where the receiver 2 is an ultrasonic receiver and the receiver 4 is a microwave antenna. The arrangement constructed in accordance with FIG. 1 is provided for operation according to the coincidence principle corresponding to the above-identified earlier proposal with coincidence of ultrasonic Doppler signal and microwave signal. The corresponding Doppler frequency signals $S_{US}$ and $S_{MW}$ occur at the terminals 3 and 5 of the circuit arrangement. As already described above with respect to the earlier application of Heywang et al, the signal $S_{US}$ normally has a fundamentally higher Doppler frequency than the signal $S_{MW}$. To facilitate the frequency comparison in a product detector 12, it is advisable to effect a frequency division of the ultrasonic Doppler frequency signal $S_{US}$ with a frequency divider 111. The advantages of such a normalization have been set forth above and are discussed in detail in the earlier application.

Preferably, the product detector 12 is a double-symmetrical mixer which, when the signals $S_{US}$ and $S_{MW}$ are received on the lines 16 and 17, emits to an output line 18 frequency signals which no longer contain the input signals which were fed into the mixer 12. The desired difference frequency signal $S_{diff}$ and the sum frequency signals are emitted from the mixer 12. In the event of identity of the frequencies of the Doppler frequency signals $S_{US}$ and $S_{MW}$, taken into consideration the frequency divider 111, the signal which occurs at the output 18 is, ideally, a direct current signal. Normally, however, due to the above-mentioned circumstances, an alternating current signal having a low frequency occurs at the output 18. In accordance with the recognition on which the invention is based, however, the frequency of the signal occurring at the output 18 of the mixer 12 can, in fact, be relatively low relative to the frequency of the Doppler frequency signal of a rapidly moving object, but nevertheless, the frequency value of the output signal occurring on the line 18 can be high, considered in absolute terms. With a fixed, subsequently connected RC low pass filter 19, this would lead to an output signal having a relatively equal high frequency, but an absolutely higher frequency from the mixer 12 experiencing such a high degree of attenuation in the low pass filter 19 that the subsequently connected threshold value detector 11 would no longer recognize and forward this signal which must be identified, and indicated at an output A.

A theoretical value generator provides a reference voltage for the threshold value detector.

In order to solve the above-described problem, the present invention, considered fundamentally, provides measures which produce a change in the amplitude value of the detection threshold of the threshold value detector 11. A circuit 14 is provided which, from a voltage signal $U_e$ taken from the ultrasonic line 15, i.e. derived from the signal $S_{US}$, produces a control voltage $U_{st}$ which is fed, as a control value, to the threshold value detector 11. The circuit 14 comprises, in particular, a reciprocal frequency-voltage converter. The circuit 14, and the control signal $U_{st}$ produced from the derived signal $U_e$ has the effect of reducing the detection threshold in the threshold value detector 11, in respect of amplitude, with an increasing frequency of the Doppler frequency signal $S_{US}$. This is equivalent to an increase in sensitivity in a low pass filter 19 having constant values. Considered practically, this measure of the invention leads to the fact that the response sensitivity of the low pass filter 19 and the threshold value detector 11, taken together, for the detection result relative to the tolerance width is rendered independent of the instantaneous speed of the object to be detected.

The above-described frequency-dependent reduction in the amplitude of the detection threshold, which has been produced by the control signal $U_{st}$ can, in accordance with the principles of the invention, also be effected or understood in that the output signal from the low pass filter 19, which simultaneously constitutes the input signal on the line 13 of the threshold value detector 11, experiences an amplitude amplification corresponding to the frequency of the control signal $U_{st}$ with an equal amplitude value of the detection threshold. According to the invention, a reduction in the detection threshold which is controlled by the control signal $U_{st}$ and controlled in dependence upon the frequency of the signal $S_{US}$ when a signal is supplied directly, i.e. unamplified, from the low pass filter 19 on the line 13, on the one hand, produces the same effect as a detection threshold which remains at the same height with a preliminary amplification, controlled independence upon the frequency of the Doppler frequency signal, of the output signal from the low pass filter 19 at or in the input of the threshold value detector 11 on the line 13, on the other hand.

As already indicated above, it is advisable to effect the derivation of a control signal $U_{st}$ from the particular higher frequency Doppler frequency signal which generally consists of the ultrasonic Doppler frequency signal. The higher output frequency ensures a correspondingly more rapid change in the control signal $U_{st}$ and thus a more rapid adaptation of the detection threshold.

The invention ensures that even with an unchanged degree of sensitivity of the detection for rapidly moving objects, it is ensured that some frequency signals of the input signals' $S_{US}$ and $S_{MW}$, which emanate from the product detector always lie above the relevant limit of the low pass filter 19 and, in fact, even when only a simple RC low pass element is provided.

A particularly advantageous embodiment of the converter 14, and in fact in association with a RC low pass filter, is that in which a charging capacitor is provided which is charged by a time-controlled charging and discharging circuit, where the charging begins, for example, at the beginning of a period of that Doppler frequency signal from which the control signal $U_{st}$ is derived (via the signal $U_e$). This charging is continued for one or several multiples of a half period duration of this Doppler frequency signal, whereupon the charge state thus reached, and the charging voltage, is transmitted to a storage capacitor. This is followed by a discharge of the charging capacitor employing the charging and discharging circuit. The continued repetition of the above-described process leads to the storage capacitor exhibiting a mean voltage whose level is a constantly sub-correcting voltage gauge of the instantaneous frequency of the Doppler frequency signal employed for the production of the control signal $U_{st}$. A converter 14 which operates in this manner supplies precisely the frequency characteristics which correspond to the low pass filter and which leads to the optimum sensitivity compensation corresponding to the invention and to the optimum speed-independence of the Doppler coincidence sensitivity of the circuit arrangement according to the invention.

Figure 2:
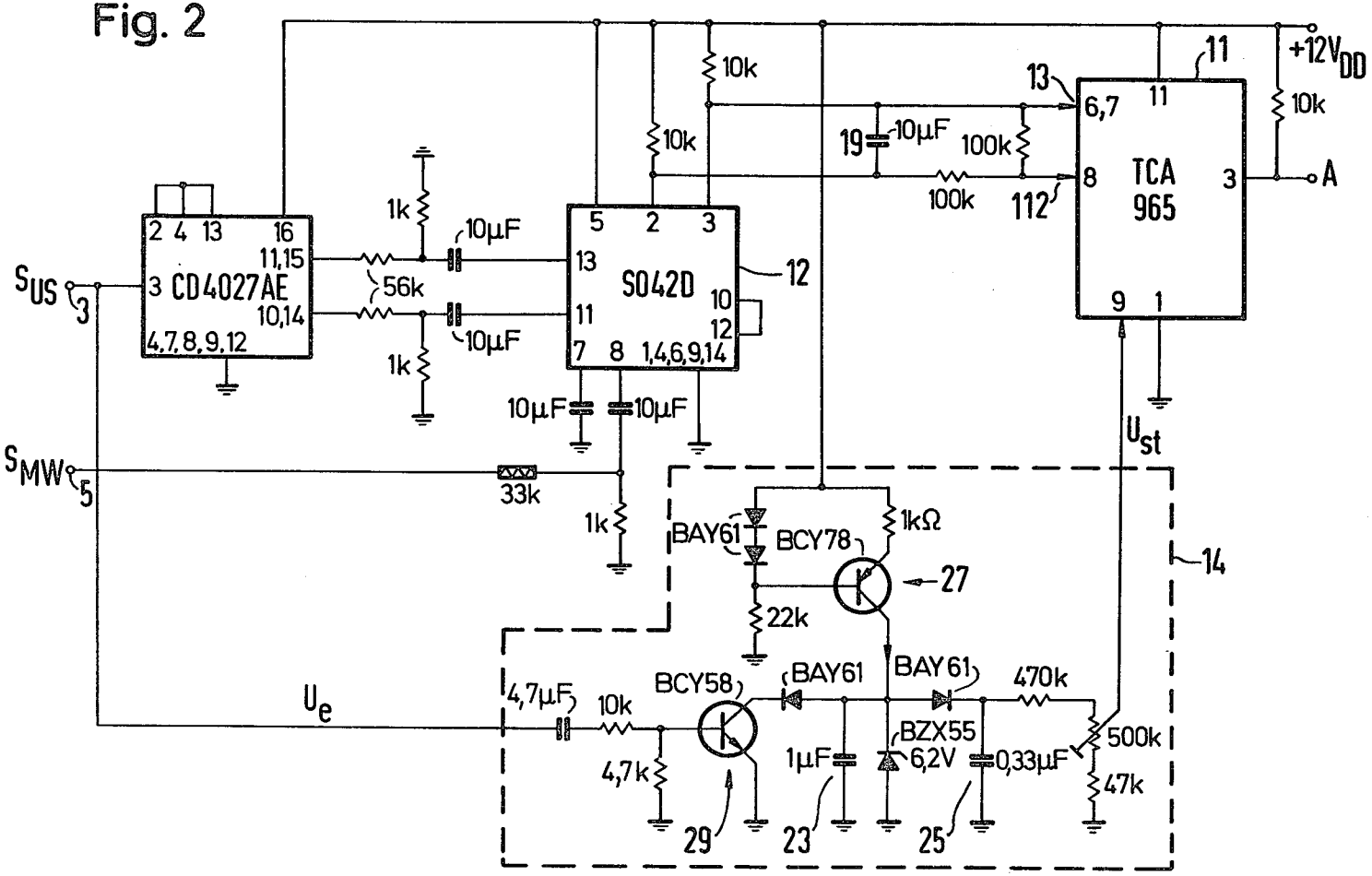
FIG. 2 is a schematic circuit diagram constructed in accordance with the invention, with elements similar to those illustrated in FIG. 1 bearing the same reference characters.

FIG. 2 is a schematic circuit diagram containing all the dimensioning information of a practical exemplary embodiment which will be required by one skilled in the art but which is not necessarily readily apparent thereto. Fundamentally, no further explanations need be given in excess of the information in FIG. 2. In FIG. 2, a charging component 27 and a discharging component 29 are illustrated for the charging and discharging circuit of the converter 14, in which a capacitor 23 is provided as the charging capacitor and a capacitor 25 is provided as the storage capacitor.

The threshold value detector 11 is also referred to as a window discriminator. The amplitude value of this detection threshold applies both to a positive and a negative sign of the voltage present at the input 13. This is necessary because the addition of the two signals $S_{US}$ and $S_{MW}$ in the mixer 12 leads to positive or negative signs in dependence upon the relevant phase state of the signals to one another. According to the invention, the window width can be controlled, so to speak, with the control signal $U_{st}$.

The desired relationship between the Doppler frequency signal $U_e$ employed for the control signal $U_{st}$ and the amplitude value of the detection threshold and window width is reciprocally linear. With a proportional relationship between window width and control signal $U_{st}$, $$U_{st} = \propto 1/f_D$$

where $\propto$ is a proportionality factor and $f_D$ is the frequency of the signal $U_e$. This functional relationship is achieved with the converter 14 in the embodiment described above in association with the charging capacitor 23 and the storage capacitor 25 and the associated charging and discharging circuits.

For the sake of completeness, it will be pointed out that the Doppler frequency signals in each case fed to the terminals 3 and 5 contain no relevant component of non-Doppler frequency shifted, reflected transmitted signals, i.e. no such component based on reflection from stationary objects. For an appropriate flitering out of the relevant transmitting frequency, the receivers 2 and 4 contain corresponding blocking circuits.

In order to prevent circuit arrangements constructed according to the present invention from becoming loaded with arbitrarily low sum frequencies of the Doppler frequency signals, i.e. to avoid the need to make the angular frequency of the RC low pass filter 19 disadvantageously low, it is advisable to precede the input of the product mixer or mixer 12 provided in the circuit arrangement of the invention by a high pass filter which has an angular frequency of, for example, approximately 10 Hz. A high pass angular frequency of this kind blocks only those frequencies (possibly reduced by a divider 111) of the Doppler frequency signals fed to the product detector or mixer 12, which would be based on speeds irrelevant to the objects to be detected. A high pass filter of this type comprises, for example, in the circuit of FIG. 2, of the two capacitances having the 10 $\mu$F capacitance values at the input of the mixer 12, together with the input impedance of the mixer of approximately 3.5kΩ.

For the invention it is advisable for the angular frequency of the low pass filter 19 arranged following the mixer to be approximately equal to the angular frequency of the preceding high pass filter. This achieves, on the one hand, a reliable gating out of the sum frequency signals and, on the other hand, a very good sensitivity of the circuit arrangement of the invention to objects within a wide speed range, and in fact precisely by virtue of the speed-dependent control, as provided by the invention, of the detection threshold level finely effective in the circuit arrangement constructed in accordance with the invention.

While I have described the embodiment of FIG. 2 to be constructed from certain components, such as the CD4027AE, SO42D, and TCA965 circuits and BCY58 and BCY78 transistors, BAY61 diodes, and a BZX55 Zener diode, other components may be employed, and the utilization thereof is well within the skill of those versed in this art.

Although I have described my invention by reference to particular illustrative embodiments thereof, many changes and modifications, other than those set forth above, may become apparent to those skilled in the art without departing from the spirit and scope of the invention. I therefore intend to include within the patent warranted hereon all such changes and modifications as may reasonably and properly be included within the scope of my contribution to the art.

I claim:

1. A circuit arrangement for a security device, which circuit arrangement receives ultrasonic and radio Doppler-frequency signals, comprising:

a first input for receiving an ultrasonic Doppler-frequency signal;

a second input for receiving a radio Doppler-frequency signal;

a frequency converter connected to one of said inputs for normalizing the frequency of the respective received signal to the frequency of the other received signal;

a product detector connected to said frequency converter and to the other of said inputs for providing the difference frequency of the signals applied thereto;

a low pass filter connected to said product detector and having a frequency-dependent attenuation characteristic;

a threshold value detector connected to said low pass filter for providing output signals in response to signals above a threshold value; and a control voltage circuit connected to one of said inputs and to said threshold value detector to derive a control signal having a frequency which is dependent upon the frequency received at said one input, said threshold value detector including means responsive to said control voltage signal to adjust the threshold value in accordance with the frequency-dependent attenuation characteristics of said low pass filter.

2. The arrangement of claim 1, wherein the ultrasonic signal has a first frequency and the radio signal has a second, lower frequency and wherein said control voltage circuit is connected to said first input which receives the higher frequency.

3. The arrangement of claim 1, wherein said low pass filter includes means defining a frequency characteristic of an RC low pass element.

4. The arrangement of claim 1, wherein said frequency converter includes a frequency divider.

5. The arrangement of claim 1, wherein: said control voltage circuit comprises a charging capacitor, a storage capacitor electrically connected to said threshold value detector, a charging and discharging circuit connected to said capacitors, a charging and discharging circuit input connected to said first input, and a charging and discharging circuit input connected to a supply voltage, said charging and discharging circuit operable to begin charging of said charging capacitor at the beginning of a period of the signal received at said one input and during the relevant following half period to transfer the charged voltage value to said storage capacitor which then supplies the control voltage signal to said threshold value detector.

* * * * *